US009709243B2

(12) United States Patent
Wu et al.

(10) Patent No.: US 9,709,243 B2
(45) Date of Patent: Jul. 18, 2017

(54) LED TRAFFIC SIGNAL LIGHT MODULE

(71) Applicant: LITE-ON TECHNOLOGY CORPORATION, Taipei (TW)

(72) Inventors: Chao-Hsien Wu, Taipei (TW); Ching-Tsung Ni, Taipei (TW)

(73) Assignee: LITE-ON TECHNOLOGY CORPORATION, Taipei (TW)

( * ) Notice: Subject to any disclaimer, the term of this patent is extended or adjusted under 35 U.S.C. 154(b) by 26 days.

(21) Appl. No.: 14/704,600

(22) Filed: May 5, 2015

(65) Prior Publication Data

US 2015/0316216 A1 Nov. 5, 2015

(30) Foreign Application Priority Data

May 5, 2014 (TW) ..... 103207782 U

(51) Int. Cl.

| | |
|---|---|
| ***F21V 5/04*** | (2006.01) |
| ***F21V 23/06*** | (2006.01) |
| ***F21V 23/02*** | (2006.01) |
| ***B61L 5/18*** | (2006.01) |
| ***F21K 9/60*** | (2016.01) |
| *F21W 111/00* | (2006.01) |
| *F21Y 115/10* | (2016.01) |

(52) U.S. Cl.

CPC ..... *F21V 5/045* (2013.01); *B61L 5/1845* (2013.01); *F21K 9/60* (2016.08); *F21V 5/048* (2013.01); *F21V 23/023* (2013.01); *F21V 23/06* (2013.01); *B61L 5/1881* (2013.01); *B61L 2207/02* (2013.01); *F21W 2111/00* (2013.01); *F21Y 2115/10* (2016.08)

(58) Field of Classification Search

CPC ..... F21V 5/045; F21V 5/048; F21V 23/023; F21V 23/06; F21K 9/60; B61L 5/1845; B61L 5/1881; B61L 2207/02; F21W 2111/00; F21Y 2101/00

See application file for complete search history.

(56) References Cited

U.S. PATENT DOCUMENTS

| | | | | |
|---|---|---|---|---|
| 5,785,418 | A | 7/1998 | Hochstein | |
| 6,648,495 | B1 * | 11/2003 | Hsu | F21V 29/004 362/294 |
| 2004/0042208 | A1 * | 3/2004 | Wu | F21V 5/045 362/245 |
| 2004/0070519 | A1 | 4/2004 | Wu et al. | |

(Continued)

FOREIGN PATENT DOCUMENTS

| | | | |
|---|---|---|---|
| EP | 0955623 | A2 | 11/1999 |
| EP | 1801491 | A2 | 6/2007 |

(Continued)

OTHER PUBLICATIONS

Search Report Issued by EPO on Sep. 17, 2015.
Canadian Office Action dated Apr. 10, 2017.

*Primary Examiner* — Mary Ellen Bowman
(74) *Attorney, Agent, or Firm* — Rabin & Berdo, P.C.

(57) ABSTRACT

A light emitting diode (LED) traffic signal light module is provided. The LED traffic signal light module comprises a housing, an LED module, a power supply module and a lens set. The LED module is disposed on an inner wall in the housing. The power supply module is disposed in the housing, wherein the power supply module is electrically connected to the LED module. The lens set is disposed on the housing.

9 Claims, 2 Drawing Sheets

(56) References Cited

U.S. PATENT DOCUMENTS

| | | | | |
|---|---|---|---|---|
| 2008/0218993 | A1* | 9/2008 | Li | F21V 5/00 362/84 |
| 2013/0107540 | A1* | 5/2013 | Wu | F21V 5/045 362/309 |
| 2015/0316216 | A1 | 11/2015 | Wu et al. | |

FOREIGN PATENT DOCUMENTS

| | | | |
|---|---|---|---|
| EP | 2587129 | A2 | 5/2013 |
| EP | 2942258 | A1 | 11/2015 |
| JP | 2005247160 | A | 9/2005 |

* cited by examiner

LED TRAFFIC SIGNAL LIGHT MODULE

This application claims the benefit of Taiwan application Ser. No. 103207782, filed May 5, 2014, the subject matter of which is incorporated herein by reference.

BACKGROUND OF THE INVENTION

Field of the Invention

The present disclosure relates in general to a light emitting diode (LED) traffic signal light module, and more particularly to an LED traffic signal light module with a simplified structure.

Description of the Related Art

The current traffic signal light is an independent module and manufactured by integrating a light source module, a driving power, a lens set, a front lamp shell, and a rear lamp shell in one single lamp holder. Such structure is compact structure, and when one component or one module fails, the complete set of the traffic light module needs to be replaced, and more material waste will be produced.

Therefore, how to provide a traffic signal light module with an improved structure has become a prominent task for the industries.

SUMMARY OF THE INVENTION

The present disclosure is directed to a light emitting diode (LED) traffic signal light module. In the LED traffic signal light module of the embodiments, the LED module and the power supply module are directly disposed in the housing via which the heat can be dissipated directly, therefore the dissipation path is shorter and the dissipation effect is improved.

According to one embodiment of the present disclosure, a light emitting diode (LED) traffic signal light module is provided. The LED traffic signal light module comprises a housing, an LED module, a power supply module, and a lens set. The LED module is disposed on an inner wall in the housing. The power supply module is disposed in the housing, wherein the power supply module is electrically connected to the LED module. The lens set is disposed on the housing.

The above and other aspects of the disclosure will become better understood with regard to the following detailed description of the preferred but non-limiting embodiment (s). The following description is made with reference to the accompanying drawings.

DETAILED DESCRIPTION OF THE INVENTION

According to the LED traffic signal light module disclosed in the embodiments of the present disclosure, the LED module and the power supply module are directly disposed in the housing via which the heat can be dissipated directly, therefore the dissipation path is shorter and the dissipation effect is improved. Detailed descriptions of the embodiments of the present disclosure are disclosed below with accompanying drawings. In the accompanying drawings, the same numeric designations indicate the same or similar components. It should be noted that accompanying drawings are simplified so as to provide clear descriptions of the embodiments of the present disclosure, and the following detailed description are exemplary and explanatory only and are not restrictive of the disclosed embodiments as claimed. Anyone who is skilled in the technology field of the present disclosure can make necessary modifications or variations to the structures according to the needs in actual implementations.

Figure 1:
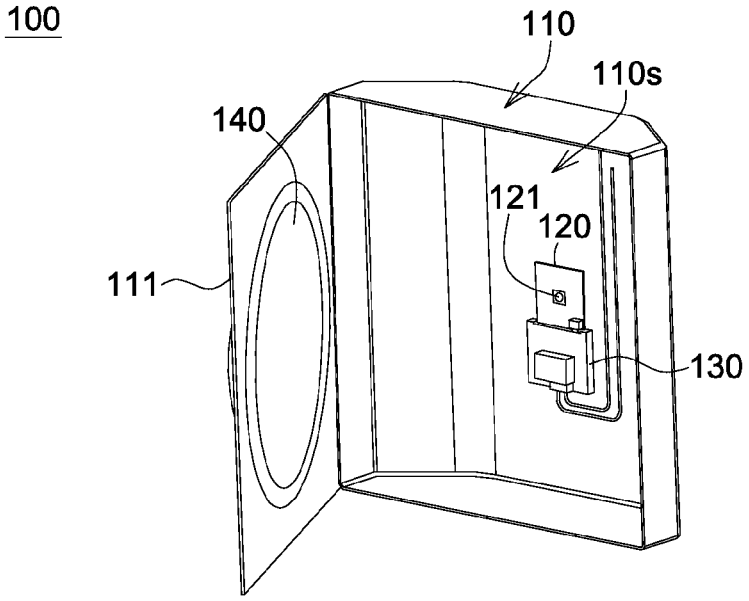
FIG. 1 is a three dimensional view of an LED traffic signal light module of the present disclosure.

FIG. 1 is a three dimensional view of an LED traffic signal light module 100 of the present disclosure. As indicated in FIG. 1, the LED traffic signal light module 100 comprises a housing 110, an LED module 120, a power supply module 130, and a lens set 140. The LED module 120 is disposed on an inner wall 110*s* in the housing 110. The power supply module 130 is disposed in the housing 110 and is electrically connected to the LED module 120. The lens set 140 is disposed on the housing 110.

In an embodiment, the LED module 120 and the power supply module 130 are directly disposed on the housing 110 instead of having to be disposed in another inner housing before being disposed in the housing 110, and no optical element, such as a reflector, is disposed between the LED module 120 and the housing 110. As such, compared to the generally known technology, wherein the heat dissipated to the housing by the LED module must first pass through the inner housing and the reflector; according to the embodiments of the present disclosure, the LED module 120 and the power supply module 130 are directly disposed on the housing 110 via which the heat can be dissipated directly, therefore the dissipation path is shorter, and the dissipation effect is improved.

In some embodiments, the material of the housing 110 comprises plastic, metal, or a combination thereof. In an embodiment, the material of the housing 110 comprises aluminum. Since aluminum has good performance in heat dissipation, and the LED module 120 and the power supply module 130 are directly disposed on the housing 110, the dissipation effect of the LED traffic signal light module 100 can further be improved.

Moreover, since the light emitted from the LED module 120 is highly directional, there is no need to install any reflector. In other words, according to the embodiments of the present disclosure, the LED traffic signal light module 100 has a simplified structure, not only providing better dissipation effect but also simplifying the manufacturing process and reducing the cost.

In an embodiment as indicated in FIG. 1, the power supply module 130 and the LED module 120 are such as disposed on the same inner wall 110 in the housing 110. In the present embodiment, the LED module 120 and the power supply module 130 are directly disposed in the housing 110, for example, the LED module 120 and the power supply module 130 are fixed in the housing 110 by way of soldering or fixing and locking.

Figure 3:
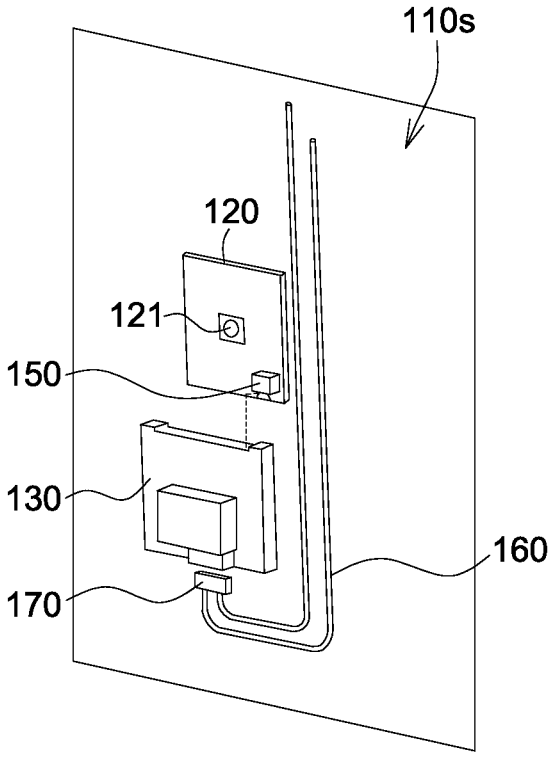
FIG. 3 is a partial three dimensional view of the LED traffic signal light module of the present disclosure.

FIG. 3 is a partial three dimensional view of the LED traffic signal light module 100 of the disclosure. As indicated in FIG. 3, the LED module 120 and the power supply module 130 are separately disposed in the housing 110. In the present embodiment, the LED module 120 and the power supply module 130 are such as separately disposed on the same inner wall 110*s* in the housing 110. Thus, when one of the LED module 120 or the power supply module 130 needs to be repaired or replaced, only the broken one needs to be taken out for repair or replacement. Such design not only increases the convenience of repairing and replacement but also saves material cost.

In an embodiment, the power supply module 130 can be electrically connected to the LED module 120 via a connector 150. In other words, the on/off state of electrical connection between the LED module 120 and the power supply module 130 can be switched by quickly plugging/unplugging the connector 150.

In another embodiment, the power supply module 130 can be fixed to the LED module 120. That is, the LED module 120 and the power supply module 130 are already fixed and connected to each other when the manufacturing process is completed. The components of the two modules are disposed on the same mounting base which is directly disposed in the housing 110.

Figure 2:
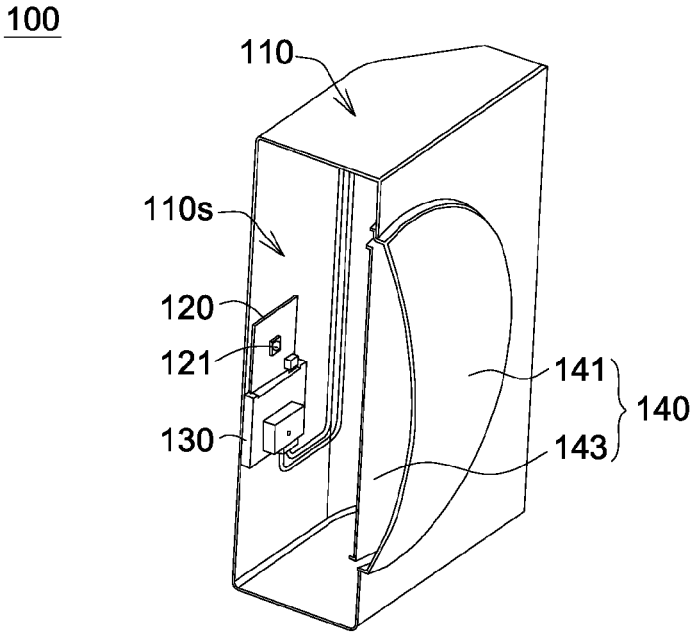
FIG. 2 is a three dimensional perspective view of the LED traffic signal light module of the present disclosure.

As indicated in FIGS. 1-3, the LED traffic signal light module 100 may further comprise a connection wire module 160. The connection wire module 160 is disposed in the housing 110, and the power supply module 130 is electrically connected to an external power via the connection wire module 160.

In an embodiment as indicated in FIG. 3, the power supply module 130 can be electrically connected to the connection wire module 160 via a connector 170. In other words, the on/off state of electrical connection between the power supply module 130 and the connection wire module 160 can be switched by quickly plugging/unplugging the connector 170.

In an embodiment, the connection wire module 160, the LED module 120, and the power supply module 130 are separately disposed in the housing 110. Such design not only increases the convenience of repairing and replacement but also saves material cost.

In an embodiment, the LED module 120 comprises at least a high-power LED 121 whose luminous power is between 3-5 W. In an embodiment, the LED module 120 may comprise several high-power LEDs 121 (not illustrated) for increasing the luminous intensity.

In an embodiment, the package structure of the LED itself has a special light structure design. Or, the LED module 120 further comprises at least an optical lens (not illustrated) disposed on the LED 121. The light emitted from the LED 121 passes through the optical lens at a light emitting angle between 80-120 degrees. In an embodiment, by adjusting the optical properties of the optical lens (such as focus, reflectivity, and so on), the optical lens incorporating with the LED 121 enables the light emitted from the LED module 120 to have a specific light emitting angle, such that the luminous efficiency of the LED module 120 can be further increased.

In an embodiment as indicated in FIGS. 1-2, the housing 110 further comprises a front panel 111. The front panel 111 is movably disposed corresponding to the light emitting direction of the LED module 120. The lens set 140 can be disposed on the front panel 111, such that the light emitted from the LED module 120 passes through the lens set 140 and proceeds towards a predetermined direction.

In an embodiment, the movable front panel 111 can be easily opened, such that the modules inside the housing 110 can be easily repaired or replaced without having to disassemble the whole structure of the housing 110 of the LED traffic signal light module 100.

In an embodiment as indicated in FIG. 2, the lens set 140 may comprise an outer lens 141 and an inner lens 143. The inner lens 143 is located between the LED module 120 and the outer lens 141.

In an embodiment, the outer lens 141 can be realized by a non-planar lens having focusing effect. Besides, partial region on the surface of the outer lens 141 can have a blurred pattern for displaying the traffic sign.

In an embodiment, the inner lens 143 can be realized by a non-planar lens such as a Fresnel lens for focusing the light emitted from the LED module 120. After the light emitted from the LED module 120 passes through the lens set 140, the light emitted from the LED traffic signal light module 100 has a light emitting angle of about 27.5 degrees towards left and/or right, 12.5 degrees upwards, and 27.5 degrees downwards.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light emitting diode (LED) traffic signal light module, comprising:

a housing, comprising a front panel;

an LED module disposed on an inner wall in the housing;

a power supply module disposed in the housing, wherein the power supply module is electrically connected to the LED module, wherein the power supply module is fixed to and arranged parallel to the LED module, the power supply module and the LED module are disposed on a mounting base disposed in the housing, and an entire bottom surface of the power supply module and an entire bottom surface of the LED module both directly contact the inner wall of the housing, wherein a material of the housing comprises a heat dissipation material; and a lens set disposed on the front panel of the housing, wherein the front panel is movable for exposing the LED module and the power supply module inside the housing, such that the LED module and the power supply module inside the housing are repaired or replaced.

2. The LED traffic signal light module according to claim 1, further comprising:

a connection wire module disposed in the housing, wherein the power supply module is electrically connected to an external power via the connection wire module.

3. The LED traffic signal light module according to claim 2, wherein the power supply module is electrically connected to the connection wire module via a connector.

4. The LED traffic signal light module according to claim 1, wherein the LED module comprises at least a high-power LED.

5. The LED traffic signal light module according to claim 4, wherein the LED module further comprises at least an optical lens disposed on the high-power LED, and a light emitted from the high-power LED passes through the optical lens at a light emitting angle of 80-120 degrees.

6. The LED traffic signal light module according to claim 1, wherein the front panel is movably disposed corresponding to a light emitting direction of the LED module.

7. The LED traffic signal light module according to claim 6, wherein a light emitted from the LED module passes through the lens set and proceeds towards a predetermined direction.

8. The LED traffic signal light module according to claim 1, wherein a material of the housing comprises a plastic material, a metal material, or a combination thereof.

9. The LED traffic signal light module according to claim 1, wherein the lens set comprises an outer lens and an inner lens.

* * * * *